US009667002B1

(12) United States Patent
Martin

(10) Patent No.: US 9,667,002 B1
(45) Date of Patent: May 30, 2017

(54) CONNECTOR ASSEMBLY WITH AN UNSHIELDED TWISTED PAIR CIRCUIT

(71) Applicant: TYCO ELECTRONICS CORPORATION, Berwyn, PA (US)

(72) Inventor: Galen M. Martin, Mechanicsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/332,374

(22) Filed: Oct. 24, 2016

(51) Int. Cl.

| | |
|---|---|
| ***H01R 11/20*** | (2006.01) |
| ***H01R 24/60*** | (2011.01) |
| ***H01R 9/03*** | (2006.01) |
| ***H01R 13/422*** | (2006.01) |
| *H01R 107/00* | (2006.01) |

(52) U.S. Cl.
CPC ..... *H01R 24/60* (2013.01); *H01R 9/03* (2013.01); *H01R 13/422* (2013.01); *H01R 2107/00* (2013.01)

(58) Field of Classification Search
CPC ... H01R 4/2433; H01R 4/2429; H01R 4/2454
USPC ..... 439/417, 395, 404, 400, 408, 521
See application file for complete search history.

(56) References Cited

U.S. PATENT DOCUMENTS 3,829,821 A * 8/1974 Derr ..... H01R 13/633 439/304
2007/0141871 A1* 6/2007 Scherer ..... H01R 23/688 439/108

* cited by examiner

*Primary Examiner* — Phuongchi T Nguyen

(57) ABSTRACT

A connector assembly includes a housing having housing cavities extending between a mating end and a loading end. The housing having module latches associated with corresponding housing cavities. Contact modules are received in corresponding housing cavities. Each contact module having first and second module cavities extending between a front end and a rear end of the contact modules. The contact modules being held within the housing cavity by the corresponding module latch. Each contact module having an unshielded twisted pair (UTP) circuit, the UTP circuit includes first and second signal wires and first and second terminals terminated to the first and second signal wires. The signal wires being twisted along a length of the first and second signal wires.

19 Claims, 11 Drawing Sheets

CONNECTOR ASSEMBLY WITH AN UNSHIELDED TWISTED PAIR CIRCUIT

BACKGROUND OF THE INVENTION

The subject matter herein relates generally to electrical connectors and connector assemblies that comprise unshielded twisted pair (UTP) circuits.

Some known electrical connectors are assembled with unshielded twisted pair (UTP) circuits. The UTP circuits may be configured to join directly to a housing of the connector assembly. The UTP circuits include first and second signal wires that are twisted outside of the housing. However, the amount of length of un-twisted signal wires is very important to the signal integrity of the electrical connector. Typically, many unshielded twisted wire pairs are terminated to the back end of the housing of the electrical connector. Such twisted wire pairs may extend from a common cable jacket. Having many wires terminated to terminals in the housing leads to relatively long lengths of the wires being exposed behind the housing. It is desirable to keep the length of un-twisted signal wires short. This can be very difficult in a typical electrical connector assembly where several different UTP circuits must also be terminated. The multiple different circuits lead to congestion of wires making it difficult to control the length of untwisted UTP circuit wires by the operator.

A need remains for an electrical connector assembly that controls the length of untwisted wires in a simplified assembly operation.

BRIEF DESCRIPTION OF THE INVENTION

In one embodiment, a connector assembly is provided comprising, a housing having housing cavities extending between a mating end and a loading end. The housing having module latches associated with corresponding housing cavities. Contact modules are received in corresponding housing cavities. Each contact module having first and second module cavities extending between a front end and a rear end of the contact modules. The contact modules being held within the housing cavity by the corresponding module latch. Each contact module having an unshielded twisted pair (UTP) circuit, the UTP circuit includes first and second signal wires and first and second terminals terminated to the first and second signal wires. The signal wires being twisted along a length of the first and second signal wires. The contact module has a primary latch surface for securing the first and second terminals in the first and second module cavities. And the contact module has a secondary latch for securing the first and second terminals in the first and second module cavities.

In a further embodiment, a connector assembly is provided comprising a housing having housing cavities extending between a mating end and a loading end. The housing having module latches associated with corresponding housing cavities. Contact modules received in corresponding housing cavities. Each contact module having first and second module cavities extending between a front end and a rear end of the contact modules. The contact modules being held within the housing cavity by the corresponding module latch. Each contact module having an unshielded twisted pair (UTP) circuit. The UTP circuit includes first and second signal wires and first and second terminals terminated to the first and second signal wires. The signal wires being twisted along a length of the first and second signal wires. The contact modules comprising a primary latch surface and a secondary latch for receiving the UTP circuit. The first and second terminals comprise a latch configured to engage the primary latch surface of the contact module, and a secondary recess configures to receive the secondary latch of the contact module.

DETAILED DESCRIPTION OF THE INVENTION

Figure 1:
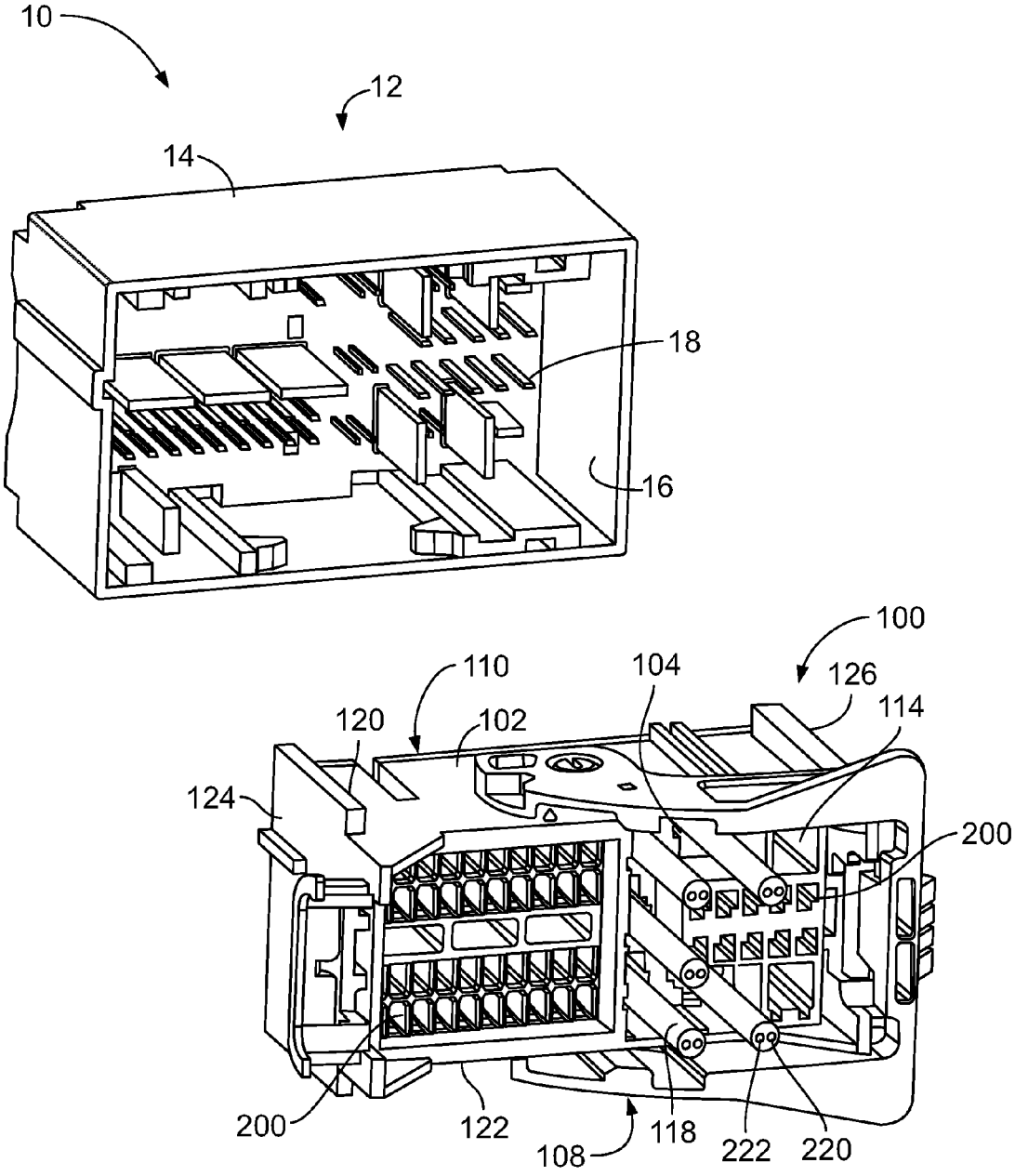
FIG. 1 is a perspective view of an electrical connector system in accordance with an embodiment of the present invention.

FIG. 1 is a perspective view of an electrical connector system 10 formed in accordance with an exemplary embodiment. The electrical connector system 10 includes a header connector 12, which may be mounted to a circuit board, and a connector assembly 100 configured to be mated with the header connector 12. The header connector 12 includes a housing 14 defining a cavity 16. The header connector 12 includes a plurality of header contacts 18 held by the housing 14 and arranged within the cavity 16 for electrical connection to the connector assembly 100. In the illustrated embodiment, the header contacts 18 are male contacts, such as pin contacts, blade contacts, and the like; however, other types of contacts may be provided in alternative embodiments. The connector assembly 100 is configured to be loaded into the cavity 16 to electrically connect to the header contacts 18. In an exemplary embodiment, the connector assembly 100 includes cables or wires extending therefrom configured to be electrically connected to corresponding header contacts 18. The cables or wires may transmit power, high speed data signals, low speed data signals, and the like. In the illustrated embodiment, twisted-pair cables are illustrated; however, other types of cables may be connected to the connector assembly 100 in various embodiments.

Figure 2:
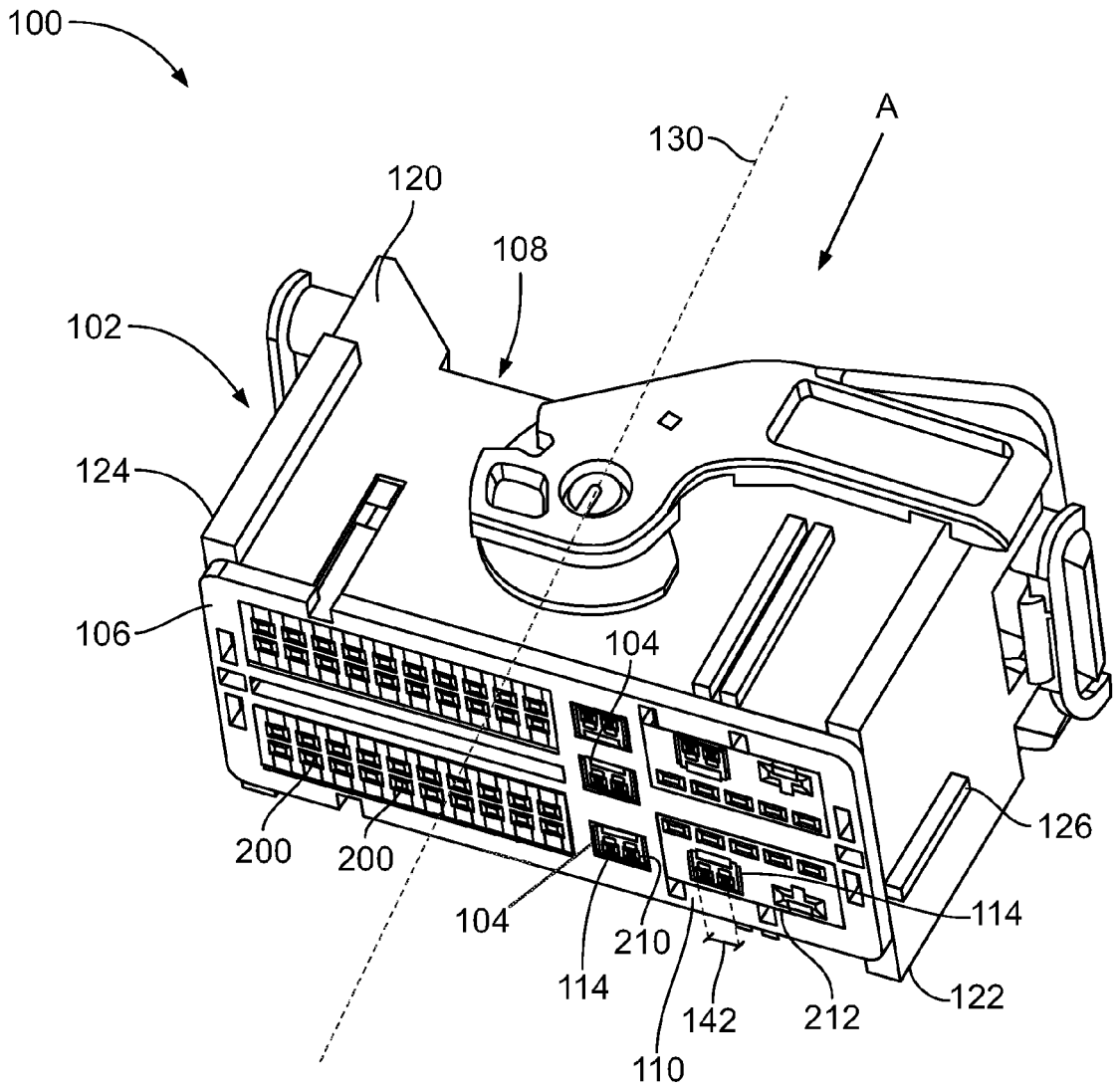
FIG. 2 is a front perspective view of the connector assembly in accordance with an embodiment of the present invention.
Figure 3:
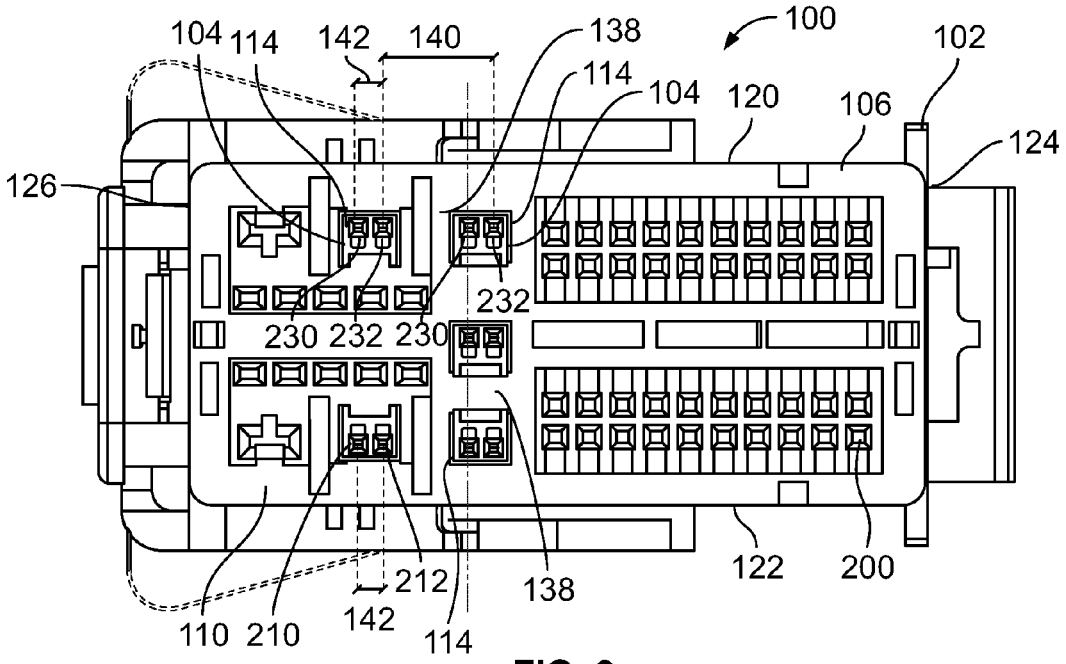
FIG. 3 is a front view of a connector assembly in accordance with an embodiment of the present invention
Figure 4:
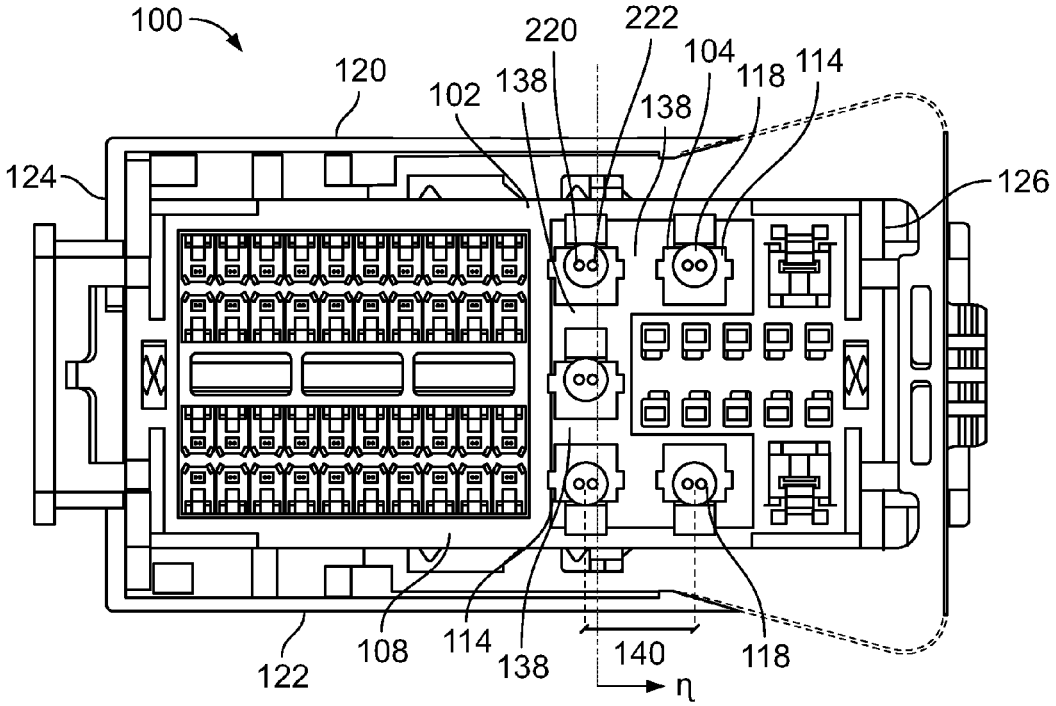
FIG. 4 is a rear view of a connector assembly in accordance with an embodiment of the present invention

FIG. 2 is a front perspective view of the connector assembly 100 in accordance with an exemplary embodiment. FIG. 3 is a front view of the connector assembly 100 in accordance with an exemplary embodiment. FIG. 4 is a rear view of the connector assembly 100 in accordance with an exemplary embodiment. The connector assembly 100 has a housing 102 holding contact modules 104 and a terminal position assurance (TPA) device 106 provided at a front end 110 of the housing 102. The connector assembly 100 includes a plurality of terminals 200 configured to be mated to corresponding header contacts 18 (shown in FIG. 1). In an exemplary embodiment, the terminals 200 include power terminals, low speed signal terminals and high speed signal terminals. In an exemplary embodiment, the high speed signal terminals are held in the contact modules 104. The high speed signal terminals may be arranged in pairs and may transmit differential pair signals. The low speed data signals may also be arranged in pairs. Other types of terminals 200 may be provided in alternative embodiments. For example, the terminals 200 may be fiber optic terminals.

The connector assembly 100 may be used in an application, such as in an automotive vehicle system, that involves interconnection of electrical or fiber optic conductors within the system. The connector assembly 100 represents a robust, low cost, compact design. Furthermore, the configuration and arrangement of the connector assembly 100 enables use of simplified design and manufacturing processes, increasing turnover and lowering cost without adversely impacting quality and reliability.

The housing 102 of the connector assembly 100 has a plurality of housing cavities 114 for receiving individual terminals 200 or individual contact modules 104 that mate with corresponding mating header contacts 18 of the mating header connector 12. The housing 102 includes a top end 120, a bottom end 122, opposed first and second sides 124, 126, the front or mating end 110 and a rear or loading end 108. The housing 102 may have any size and shape depending on the particular application and the corresponding mating connector. Additionally, while seven housing cavities 114 are illustrated in FIG. 1 that receive seven contact modules 104, any number of housing cavities 114 and contact modules 104 may be provided depending on the particular application. The housing 102 has a longitudinal axis 130 extending from the front end 110 to the loading end 108. The housing cavities 114 extend along the longitudinal axis 130.

In an exemplary embodiment, each contact module 104 include first and second terminals 230, 232. First and second signal wires 220, 222 are terminated to the first and second terminals 230, 232. The first and second terminals 230, 232 are received in corresponding first and second module cavities 210, 212 of the contact modules 104 and are configured to be loaded into the housing 102 with the contact module 104. The first and second terminals 230, 232, with the first and second signal wires 220, 222, define an unshielded twisted pair (UTP) circuit 118. The wires 220, 222 are unshielded wires that are twisted and configured to convey differential signals to the terminals 230, 232. The wires 220, 222 are twisted to tightly couple the differential signals. Loading the terminals 230, 232 into the contact module 104 allow the amount of untwisting of the wires 220, 222 to be limited to a relatively short distance (for example, immediately rearward of the contact module 104) as compared to conventional connectors that do not provide contact modules and that have the terminals arranged directly in a housing, where the amount of untwisting of the wires is longer to accommodate assembly. The contact modules 104 allow the wires 220, 222 and terminals 230, 232 to remain closely coupled and function as separate units which are self-contained and independently loaded into the housing 102. The contact modules 104 are loaded into the loading end 108 of the housing 102 in a loading direction shown by arrow A parallel to the longitudinal axis 130.

In the illustrated embodiment, the housing cavities 114, and thus the contact modules 104, are arranged in an array in rows and columns. The rows are defined as being oriented parallel to the top end 120 of the housing 102. In the illustrated embodiment, the columns are oriented vertically and the row are oriented horizontally. The first and second terminals 230, 232 defining a particular UTP circuit 118 are arranged in the same row. The housing cavities 114 may be shaped and sized to receive the contact modules 104 in an alternative orientation. For example, the contact modules 104 may be loaded into the housing cavities 114 at an orientation rotated 90 degrees from the illustrated embodiment. Thus the first and second terminals 230, 232 may be arranged in the same column.

The housing 102 of the connector assembly 100 is manufactured from a dielectric material, for example a plastic material. The housing 102 includes one or more separating walls 138 between the first and second housing cavities 114. The separating walls 138 separate each of the housing cavities from each other housing cavity. The separating walls 138 define separate cavities that receive corresponding contact modules 104. Optionally, the separating walls 138 may provide electrical shielding between each of the contact modules 104. For example, the walls may include metal plates or other shield structures between the contact modules 104.

In an exemplary embodiment, the contact modules 104 define an intra-pair spacing 142 between the first and second terminals 230, 232 held by the corresponding first and second module cavities 210, 212 of the contact module 104. The contact modules 104 may control the spacing between the first and second terminals 230, 232 to control the intra pair coupling of the UTP circuit 118 and/or to control crosstalk. Thicknesses of the separating walls 138 controls the spacing between the housing cavities 114, and thus an inter pair spacing 140 between terminals 230, 232 of different, adjacent contact modules 104. The intra pair spacing 142 and the inter pair spacing 140 may be designed to improve signal integrity. Alternatively or additionally, the inter pair spacing 140 distance may be determined for other electrical requirements. Optionally, the intra pair spacing 142 is less than the inter pair spacing 140.

The TPA device 106 is movably coupled to the mating end 110 of the housing 102. The TPA device 106 is used to ensure that the terminals 200 are properly located within the housing 102. In an exemplary embodiment, the TPA device 106 is used to ensure that the contact modules 104 are properly located within the housing 102.

Figure 5:
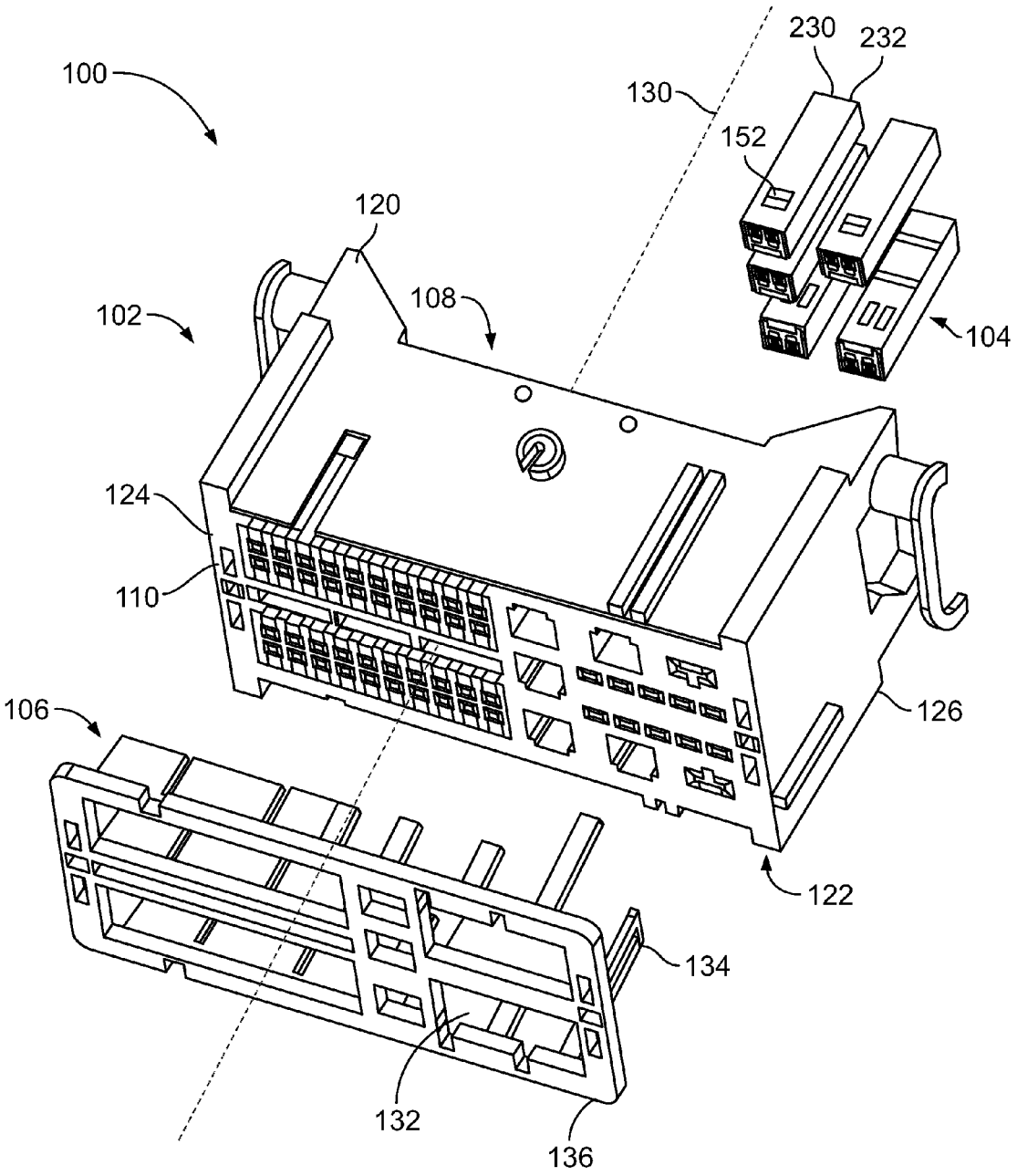
FIG. 5 is a front perspective exploded view of a connector assembly in accordance with an embodiment of the present invention.
Figure 6:
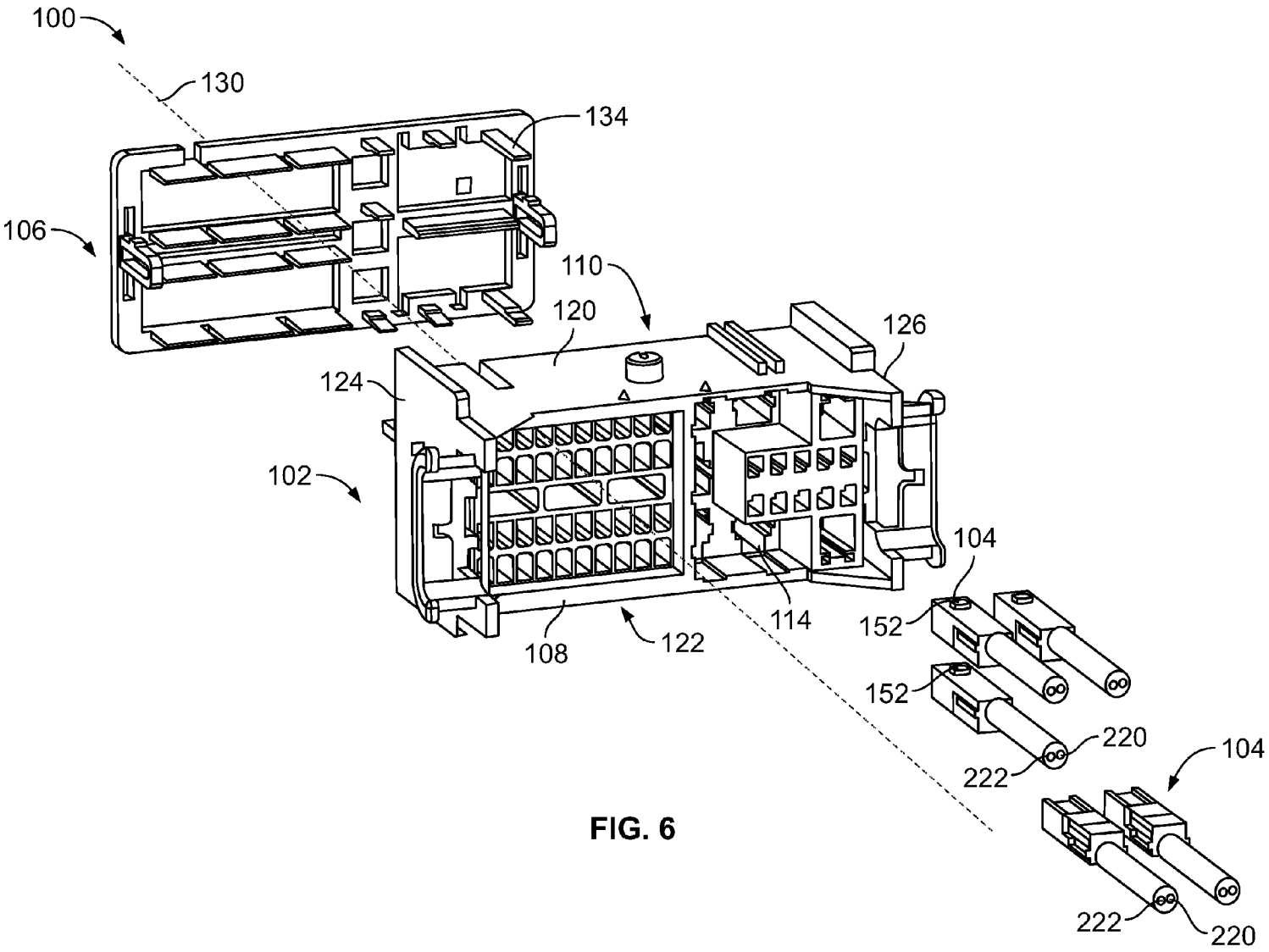
FIG. 6 is a rear perspective exploded view of a connector assembly in accordance with an embodiment of the present invention.
Figure 7:
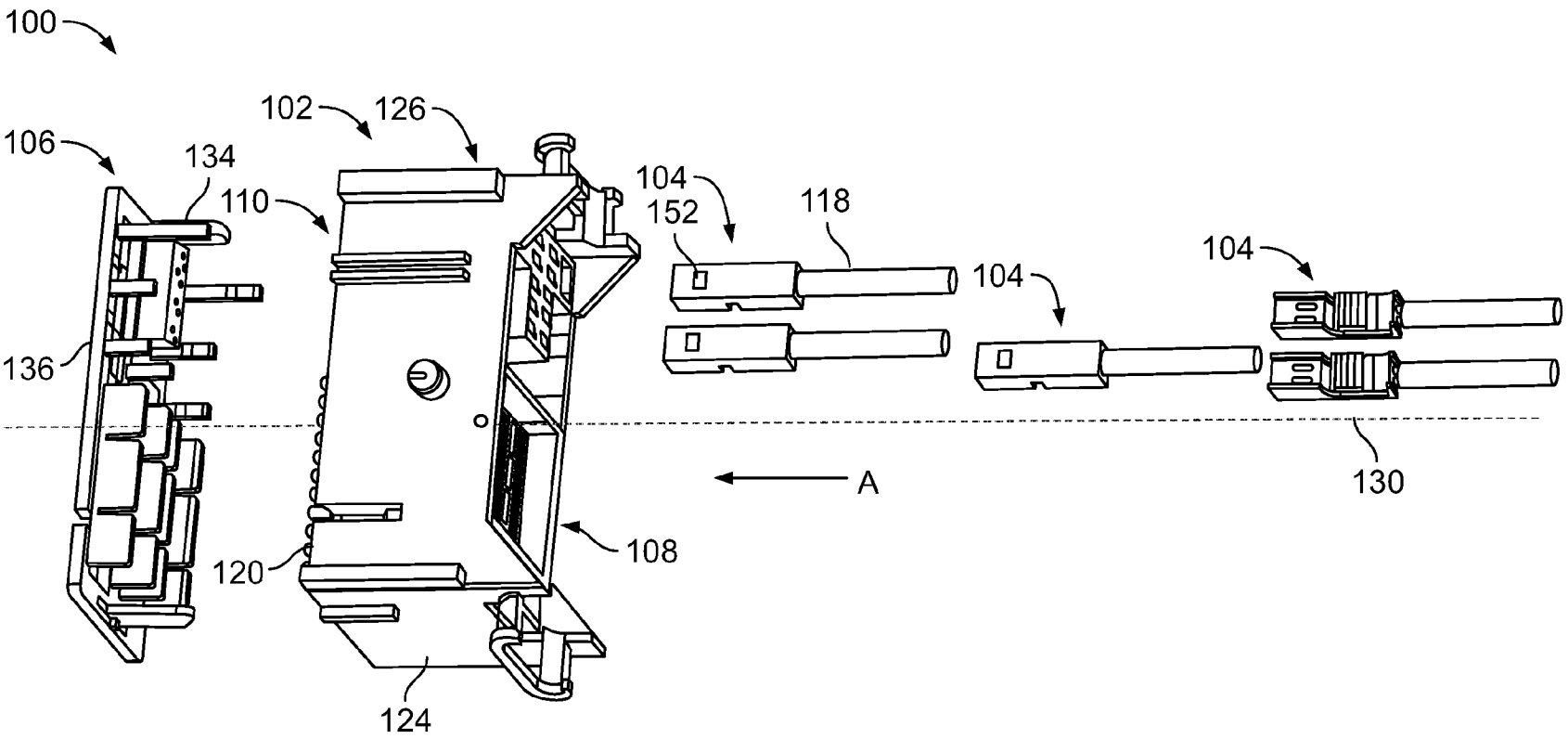
FIG. 7 is a perspective exploded view of a connector assembly in accordance with an embodiment of the present invention.

FIG. 5 is a front perspective, exploded view of the connector assembly 100 in accordance with an exemplary embodiment. FIG. 6 is a rear perspective, exploded view of the connector assembly 100 in accordance with an exemplary embodiment. FIG. 7 is a perspective, exploded view of the connector assembly 100 in accordance with an exemplary embodiment. During assembly, the first and second terminals 230, 232 are loaded into the corresponding contact modules 104. The contact modules 104 are then configured to be loaded into the housing 102, such as through the loading end 108. The contact modules 104 are sized and shaped to fit in corresponding housing cavities 114. For example, in the illustrated embodiment, the contact module 104 is generally rectangular in shape. Alternatively, the contact module 104 may be an alternative shape that is the shape and size of the corresponding housing cavity 114. The contact modules 104 are configured to be held in the housing cavities 114 using module latches 150. The module latches 150 may be secured to protrusions 152 on the contact modules 104 to hold the contact modules 104 in the housing 102.

The TPA device 106 is configured to be coupled to the mating end 110. The TPA device 106 includes a faceplate 136 and a plurality of cavity openings 132 therethrough. The faceplate 136 may be generally planar at a front end of the TPA device 106. The header contacts 18 (shown in FIG. 1) of the header connector 12 (shown in FIG. 1) are inserted into the housing cavities 114 through the cavity openings 132 in the TPA device 106. The TPA device includes TPA arms 134 extending rearward from the faceplate 136. The TPA arms 134 are used to block the module latches 150 to lock the contact modules 104 in the housing 102. The TPA arms 134 may be used to block other latches (not shown) used to hold the other terminals in other areas of the housing 102 (for example, the power terminals, the low speed signal terminals, and the like).

Figure 8:
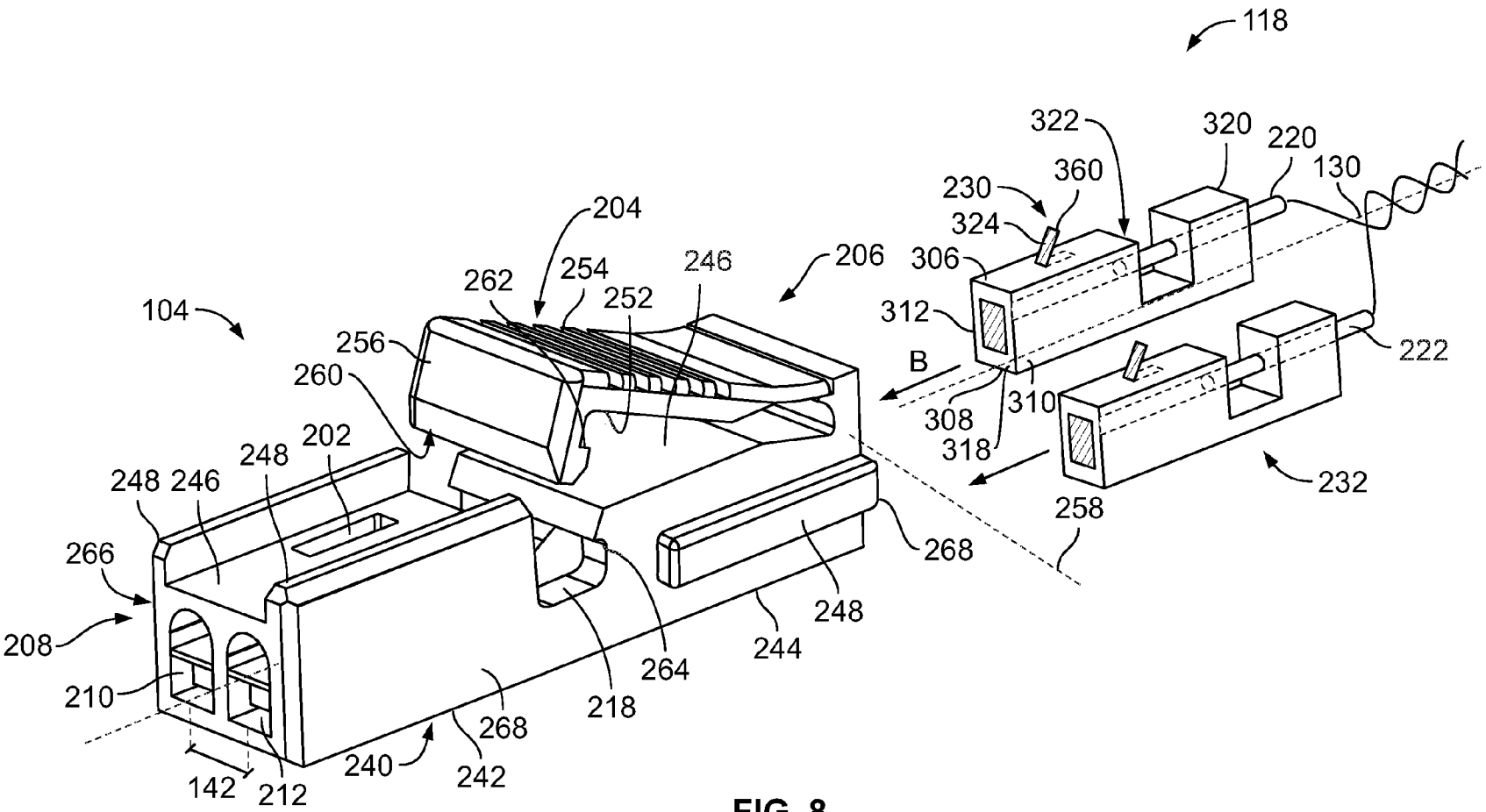
FIG. 8 is a front perspective exploded view of a contact module in accordance with an embodiment of the present invention.

FIG. 8 is a front perspective, exploded view of one of the contact modules 104 in accordance with an exemplary embodiment. The contact module 104 includes a rear end 206, a front end 208, a bottom end 240, a top end 246, and first and second sides 266, 268. The contact module 104 includes a primary latch surface 202 and a secondary latch 204 used to hold each terminal 230, 232 in the corresponding module cavity 210, 212.

In the illustrated embodiment, the primary latch surfaces 202 are located on the top end 246 and extend into the module cavities 210, 212. Optionally, the primary latch surfaces 202 may be positioned on a different wall of the contact module 104. The primary latch surfaces 202 may be a recess to receive a latch extending from the first and second terminals 230, 232.

The secondary latch 204 is joined to the contact module at or near the rear end 206. In the illustrated embodiment, the secondary latch 204 is a hinged latch or simply a hinge. The secondary latch 204 includes a hinge top end 254, a hinge bottom end 252, a hinge front end 256, a hinge fixed end 258 and a hinge latch 260 that includes a hinge ledge 262 used for latching the secondary latch 204. The secondary latch 204 is movable between opened and closed positions about a hinge pivot axis. When the secondary latch 204 is in a closed position, the hinge bottom end 252 is proximate to the top end 246. The hinge latch 260 is received in a hinge recess 218 of the contact module 104 in the closed position. The hinge ledge 262 of the secondary latch 204 is configured to mate with a hinge recess lip 264 when the secondary latch 204 is in the closed position. The hinge recess lip 264, when mated to the hinge ledge 262, holds the secondary latch 204 in the closed position and prevents the secondary latch 204 from rotating to the open position. The hinge recess 218 is positioned between a primary latch end 242 and a secondary latch end 244. The hinge recess 218 defines an open length of the contact module 104. As such, when the hinge latch 260 is received in the hinge recess 218, the hinge latch 260 may interact directly with the terminals 230, 232. For example, the hinge latch 260 may block removal of the terminals 230, 232 from the module cavities 210, 212.

The contact module 104 includes guide rails 248 for guiding the contact module 104 into the housing cavity 114 (shown in FIGS. 5-7). The guide rails 248 are shaped and sized to be received in the corresponding housing cavity 114 when the contact module 104 is assembly into the housing 102. For example, the guide rails 248 may prohibit loading into the housing cavity 114 if the contact module 104 is oriented in a wrong direction. In the illustrated embodiment, some of the guide rails 248 extend from the top end 246, such as at or near the front end 208. Additionally, some of the guide rails 248 extend from the sides 266, 268, such as at or near the rear end 206. The guide rails 248 may be provided at other locations in alternative embodiments. Having guide rails 248 extend from different walls or areas of the contact module 104 secure and/or guide the contact module 104 in different directions (e.g., side-to-side, front-to-back, up-and-down).

The contact module 104 is illustrated with the first and second module cavities 210, 212. The module cavities 210, 212 extend through the contact module 104 along the longitudinal axis 130 from the front end 208 to the rear end 206. The first and second module cavities 210, 212 define the intra pair spacing 142 distance between the center of the first module cavity 210 and the center of the second module cavity 212. Optionally, the intra pair spacing 142 distance may be based on signal integrity requirements between the first and second signal wires and terminals. The module cavities 210, 212 are shaped and sized to receive the header contacts 18 at the front end 208. Additionally, the module cavities 210, 212 are shaped and sized to receive the first and second terminals 230, 232 at the rear end 206. Additionally or alternatively, the first and second module cavities 210, 212 may be of an alternative shape and/or size.

The UTP circuit 118 includes the first and second terminals 230, 232 connected with the first and second signal wires 220, 222. The first and second terminals 230, 232 are generally rectangular in shape. The first and second terminals 230, 232 are shaped and sized to be received into the module cavities 210, 212 at the rear end 206. Additionally or alternatively, the first and second terminals 230, 232 may be of an alternative shape and/or size. The first and second terminals 230, 232 are generally of the same design and may be identical.

The first terminal 230 includes a bottom end 308, a top end 306, a front end 318, a back end 320, and first and second sides 310, 312. The first terminal 230 includes a latch 324 configured to engage the primary latch surface 202 of the contact module 104. The latch 324 extends from the top end 306 away from the first terminal 230. The latch 324 may be a deflectable latch configured to engage the primary latch surface 202. The primary latch surface 202 may receive the deflectable latch 324 to engage the terminals 230, 232. The latch 324 may be releasable from the primary latch surfaces 202 to allow removal of the terminals 230, 232 from the module cavities 210, 212. The first terminal 230 also includes a secondary recess 322 that is configured to receive the secondary latch 204 of the contact module 104.

The first signal wire 220 is terminated to the first terminal 230 at the back end 320 of the first terminal 230. The first signal wire 220 may be crimped to the first terminal 230. Alternatively, the first signal wire 220 may be terminated by other means, such as welding. Similarly, the second signal wire 222 is terminated to the second terminal 232 at the back end 320 of the second terminal 232. The first and second signal wires 220, 222 are untwisted a short length to connect to the corresponding first and second terminals 230, 232. The first and second signal wires 220, 222 remain twisted rearward of the first and second terminals 230, 232.

Figure 9:
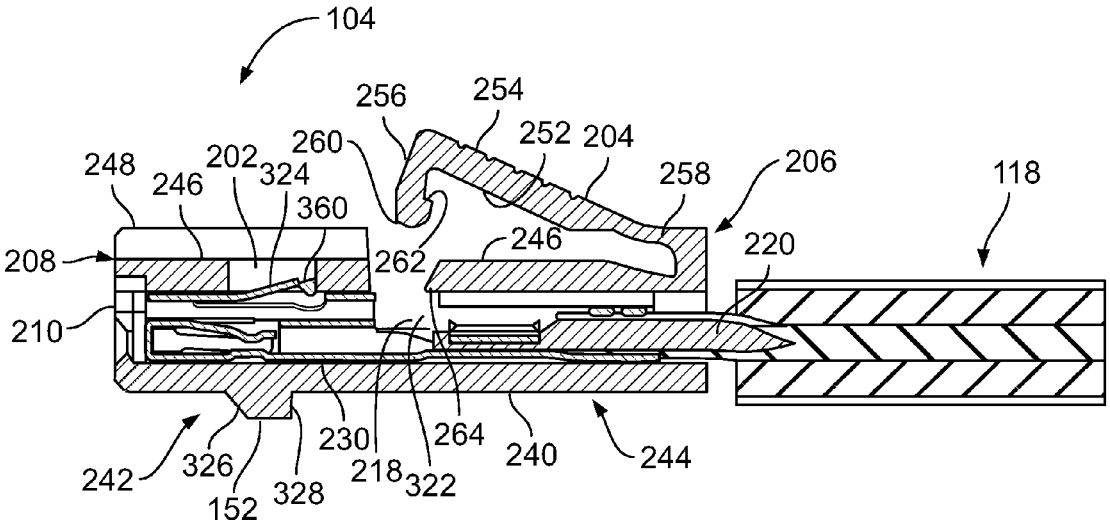
FIG. 9 is a cross-sectional view of a contact module in accordance with an embodiment of the present invention.
Figure 10:
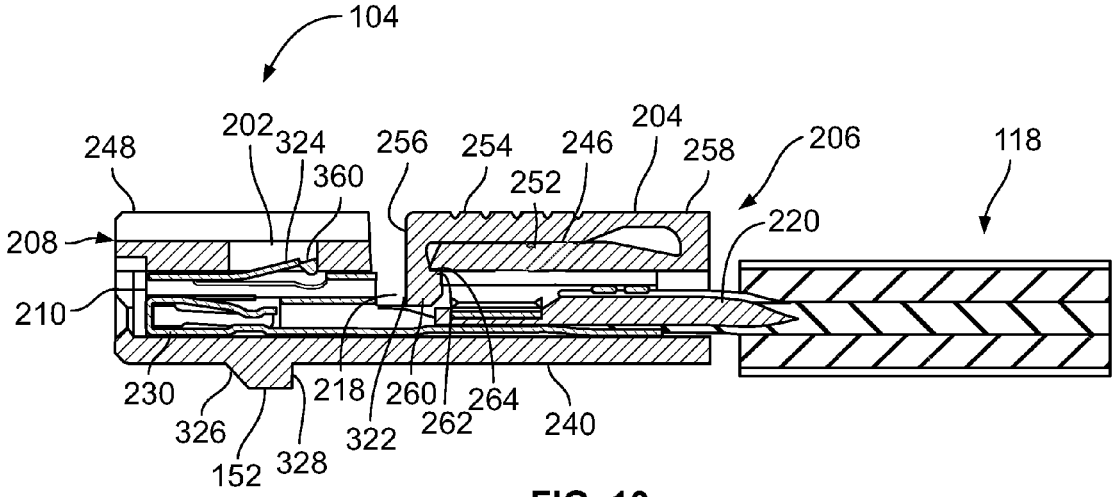
FIG. 10 is a cross-sectional view of a contact module in accordance with an embodiment of the present invention.

FIG. 9 is a cross-sectional view of the contact module 104 in accordance with an exemplary embodiment. FIG. 10 is a cross-sectional view of the contact module 104 in accordance with an exemplary embodiment. FIGS. 9 and 10 illustrate the first terminal 230 in the contact module 104. FIG. 9 illustrates the secondary latch 204 in the open position. FIG. 10 illustrates the secondary latch 204 in the closed position.

The contact module 104 includes the protrusion 152, such as near the front end 208. The protrusion 152 is configured to engage the module latch 150 to secure the contact module 104 in the housing cavity 114 of the housing 102. In the illustrated embodiment, the protrusion 152 extends from the bottom end 240 and away from the contact module 104. Optionally, the protrusion 152 may extend from an alternative side of the contact module 104. The protrusion 152 includes a ramp side 326 and a locking end 328. The ramp side 326 faces the front end 208 of the contact module 104. The locking end 328 faces the rear end 206 of the contact module 104. The protrusion 152 is integral with the contact module 104.

When assembled, the primary latch surface 202 receives the latch 324 of the first terminal 230. The latch 324 includes a deflectable latch arm. In an exemplary embodiment, the latch 324 is cantilevered from a wall of the first terminal 230. The latch 324 is integral with the first terminal 230. Alternatively, the latch 324 may be a separate component to the first terminal 230 that is coupled to the first terminal 230. The latch 324 extends into the primary latch surface 202 of the contact module 104 to a latch end 360. The latch end 360 is received in the primary latch surface 202 of the contact module 104 when the first terminal 230 has been fully loaded into the module cavity 210. The primary latch surface 202 prohibits the first terminal 230 from moving in a rearward direction and thus prevents removal of the first terminal 230.

The secondary latch 204 is movable between the open position (FIG. 9) and the closed position (FIG. 10). For example, the secondary latch 204 is pivoted or hinged about the hinge fixed end 258. The secondary latch 204 is moved to the closed position after the first and second terminals 230, 232 are assembled with the contact module 104 within the first and second module cavities 210, 212. The secondary latch 204 is moved to the closed position by transferring, such as by pushing, the secondary latch 204 in a rotational direction towards the contact module 104. The secondary latch 204 travels over the hinge recess lip 264 until the hinge ledge 262 mates with the hinge recess lip 264 in a latched position. The hinge recess lip 264 restricts opening of the secondary latch 204.

In the closed position, the secondary latch 204 is received in the hinge recess 218. The secondary latch 204 is received in the secondary recess 322 of the first terminal 230 to block removal of the terminal 230. The secondary recess 322 is sized and shaped to receive the secondary latch 204. When the secondary latch 204 is in the closed position, the hinge front end 256 engages and blocks terminal 230. The terminal secondary recess 322 prohibits the first terminal 230 from moving in a rearward direction. The secondary latch 204 provides a redundant or secondary lock for retaining the first terminal 230 in the first module cavity 210 of the contact module 104, such as if the primary latch surface 202 were to fail or break.

Figure 11:
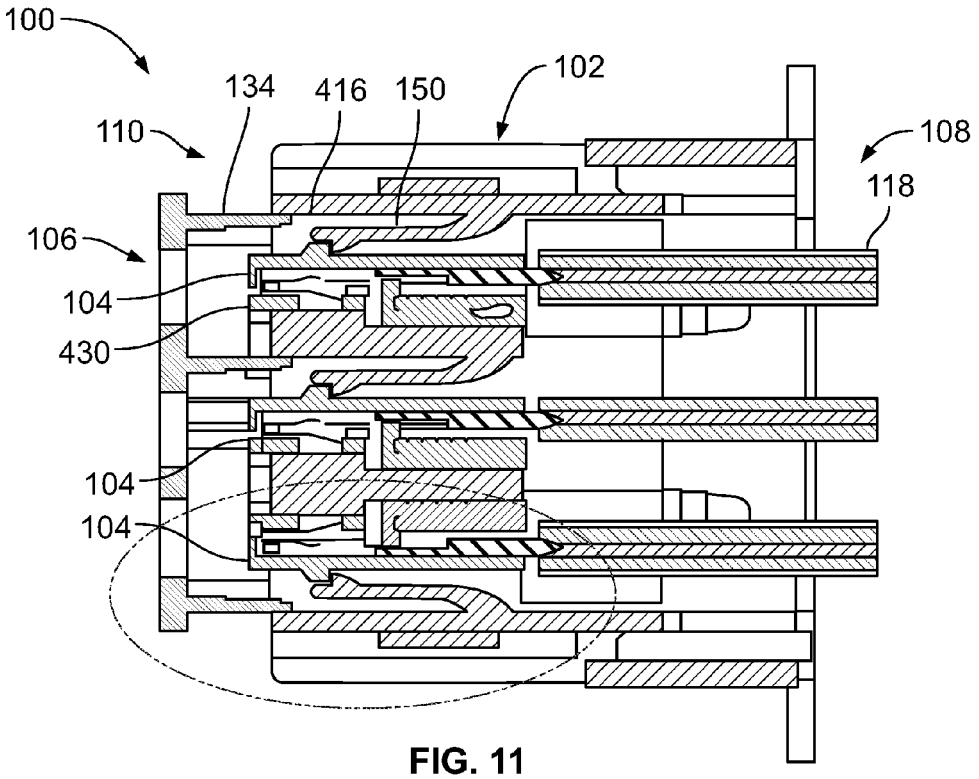
FIG. 11 is a cross-sectional view of a connector assembly in accordance with an embodiment of the present invention.
Figure 12:
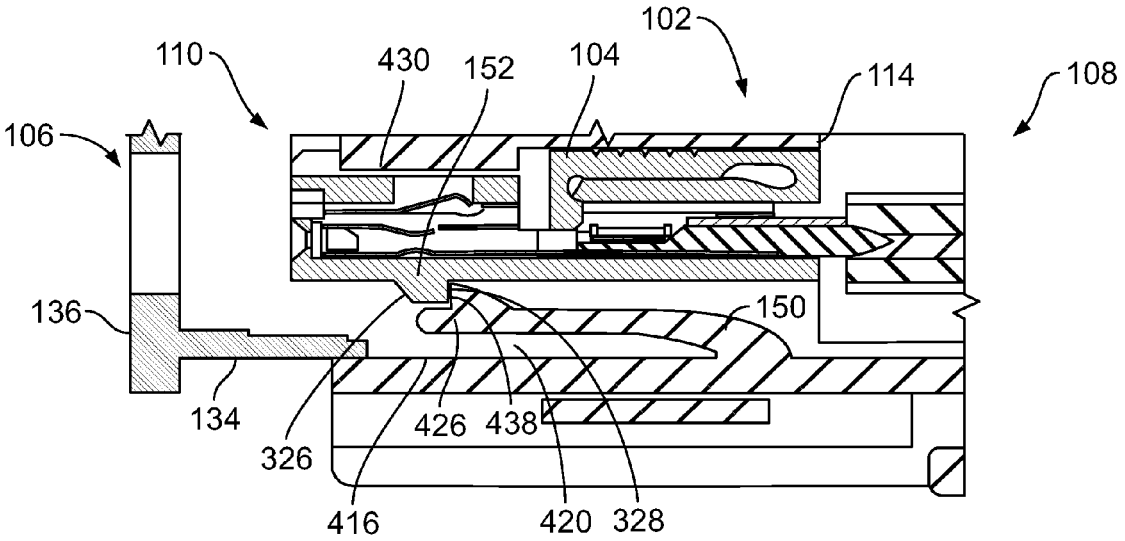
FIG. 12 is an enlarged cross-sectional view of a connector assembly in accordance with an embodiment of the present invention.
Figure 13:
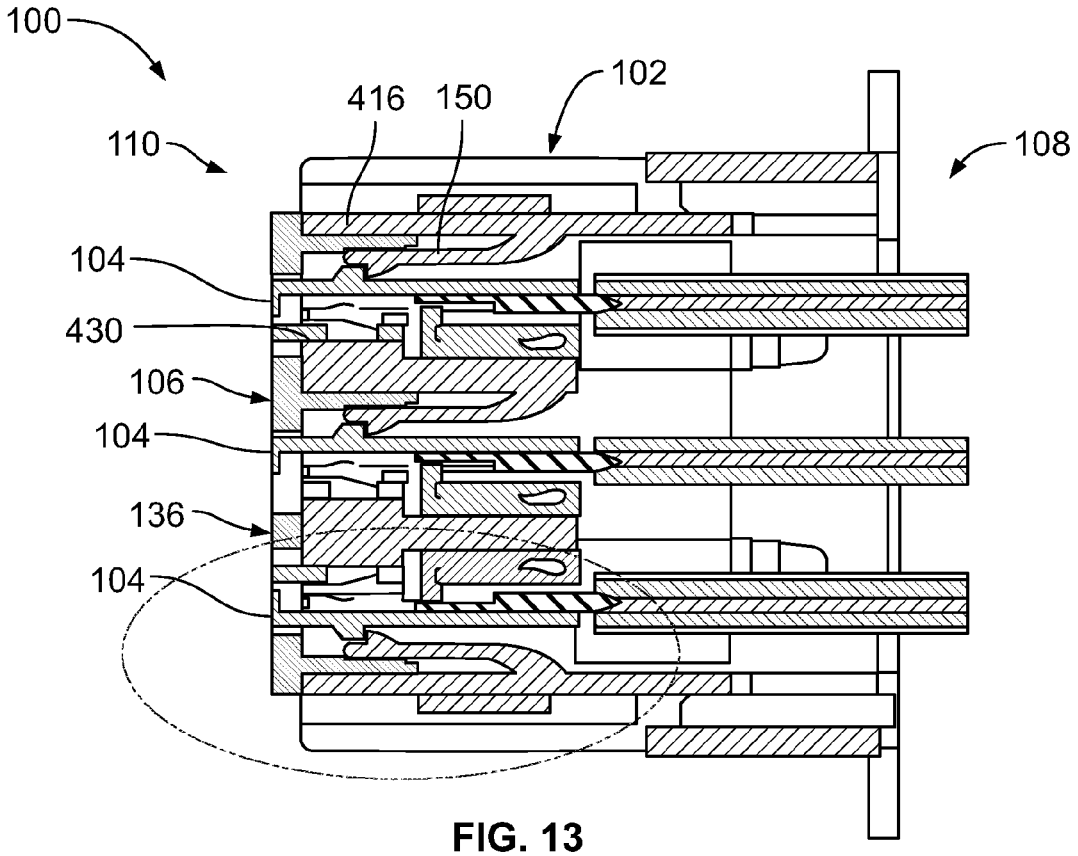
FIG. 13 is a cross-sectional view of a connector assembly in accordance with an embodiment of the present invention.
Figure 14:
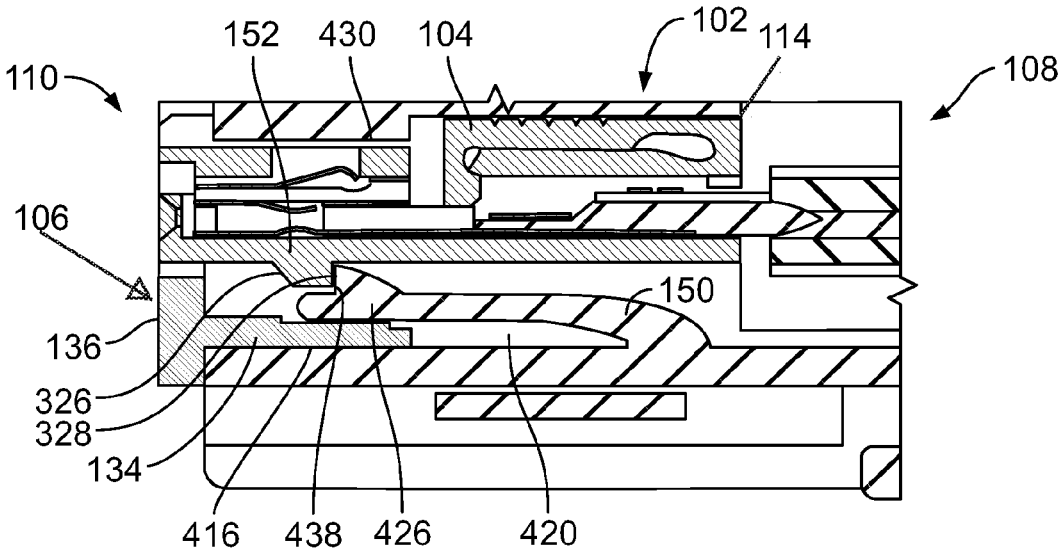
FIG. 14 is an enlarged cross-sectional view of a connector assembly in accordance with an embodiment of the present invention.

FIG. 11 is a cross-sectional view of the connector assembly 100 showing the TPA device 106 in a clearance position. FIG. 12 is an enlarged, cross-sectional view of a portion of the connector assembly 100 showing the TPA device 106 in the clearance position. FIG. 13 is a cross-sectional view of the connector assembly 100 showing the TPA device 106 and a blocking position. FIG. 14 is an enlarged cross-sectional view of a portion of the connector assembly 100 showing the TPA device 106 in the blocking position. During assembly, the contact modules 104, with the first and second terminals 230, 232 loaded therein, are assembled to the housing 102. For example, the contact modules 104 are loaded into the housing cavity 114.

The housing cavity 114 is defined by a top wall 416 and a bottom wall 430. The housing 102 includes the module latch 150 provided within the housing cavity 114. The module latch 150 is positioned proximate the top wall 416 of the housing cavity 114. In an exemplary embodiment, the latch 150 is cantilevered from a wall of the housing cavity 114 and is deflectable within the housing cavity 114. The module latch 150 extends to a latching end 426. In an exemplary embodiment, the latching end 426 of the latch 150 is spaced apart from the top wall 416 of the housing cavity 114 forming a flex space 420 therebetween. The flex space 420 allows the module latch 150 to flex into the flex space 420 as the contact module 104 is being loaded into the housing cavity 114.

During loading of the contact module 104 into the housing cavity 114, the module latch 150 is flexed outward to an unlatched position. For example, as the ramp 326 of the contact module 104 engages the module latch 150, the module latch 150 is pivoted into the flex space 420. In an exemplary embodiment, when the module latch 150 is pushed into the flex space 420, the latching end 426 of the module latch 150 is substantially, axially aligned with the arm 134 of the TPA device 106. The TPA device 106 is thus restricted from closing, as the arm 134 would engage the module latch 150 if the TPA device 106 were closed or pushed inward. In the unlatched position, a notch 438 of the module latch 150 is non-engaging or non-latching with the locking end 328 of the contact module 104, as compared to when the module latch 150 is in a latched position (FIG. 12).

After the contact module 104 is fully loaded into the housing cavity 114, the module latch 150 is moved to the latched position. For example, once the contact module 104 is loaded to a certain depth, the locking end 328 of the contact module 104 clears the latching end 426 of the module latch 150, which allows the module latch 150 to move to the latched position. In the latched position, the latching end 426 engages the locking end 328 of the contact module 104. For example, the notch 438 receives the locking end 328 of the contact module 104. In the latched position, at least a portion of the module latch 150 is positioned rearward of the contact module 104 and blocks rearward movement of the contact module 104 in an unloading direction. In the latched position, the flex space 420 is generally open to receive the arm 134 of the TPA device 106 and the module latch 150 is positioned away from the top wall 416 of the housing cavity 114.

Once the contact modules 104 are loaded into the housing 102, the TPA device 106 may be closed. The TPA device 106 is moved from the released or open position (FIG. 11) to a closed or blocking position (FIG. 13). The TPA device 106 is moved to the blocking position by transferring, such as by pushing, the TPA device 106 in a rearward direction.

In the blocking position, the arms 134 of the TPA device 106 block the module latches 150 from moving radially outward. For example, the arm 134 is at least partially received in the flex space 420 generally radially outward of the module latch 150. The module latch 150 is blocked from flexing outward to a point where the contact module 104 may be moved in an unloading direction. The TPA device 106 thus operates as a locking feature to lock the module latches 150 and contact module 104 within the housing cavity 114. As described above, the TPA device 106 is restricted from moving to the blocking position unless the module latch 150 is in the latched position as the module latch 150 closes access to the flex space 420 when in the unlatched position. Having the TPA device 106 in the blocking position thus assures the position of the module latch 150 in the latched position.

Figure 15:
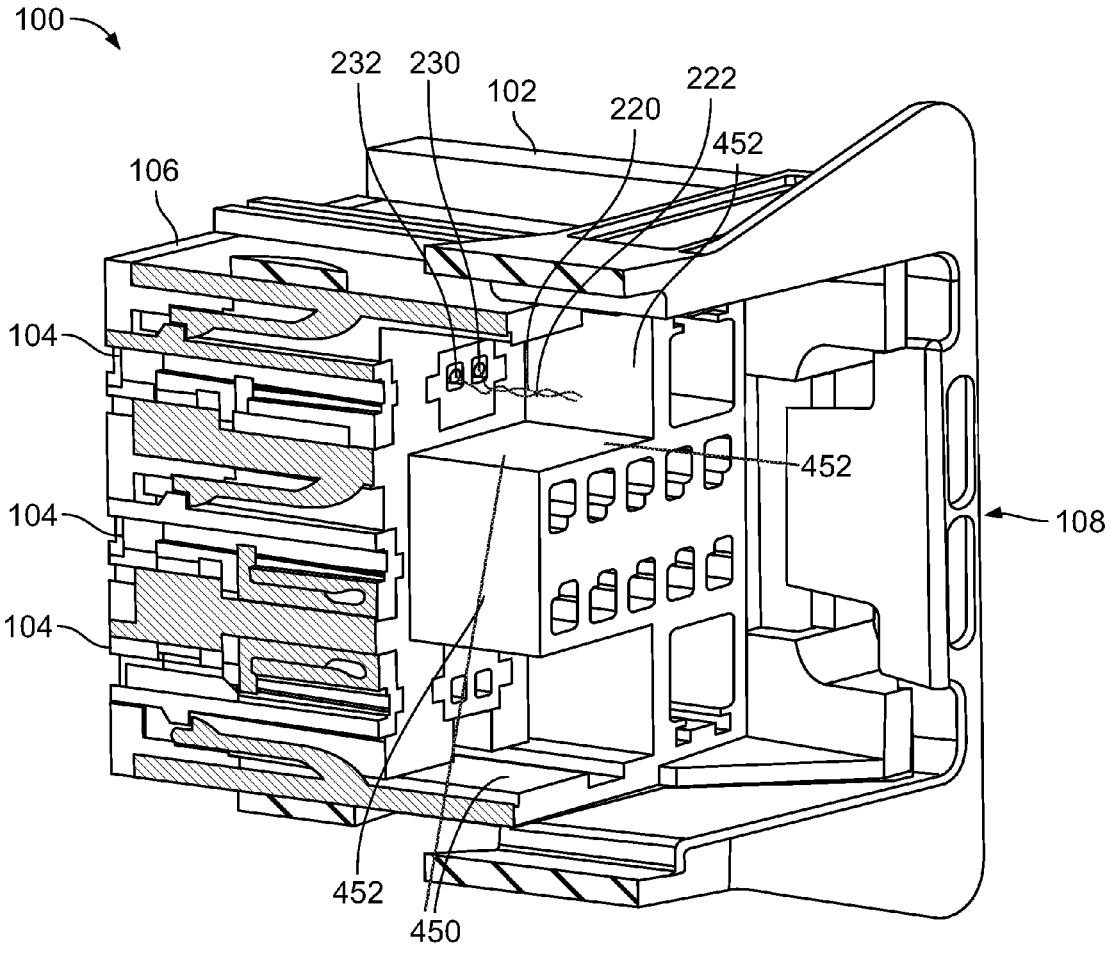
FIG. 15 is a cross-sectional perspective view of a connector assembly in accordance with an embodiment of the present invention.

FIG. 15 is a partial sectional view of the connector assembly 100. FIG. 15 illustrates the contact modules 104 loaded into the housing cavities 114 at the loading end 108 of the housing 102. The first and second signal wires 220, 222 extend rearward from the first and second module cavities 210, 212. The first and second signal wires 220, 222 that define the UTP circuit 118 are untwisted along a short length behind the first and second terminals 230, 232. However, rearward of the short length of untwisted portions of the wires 220, 222, the wires 220, 222 are twisted. In an exemplary embodiment, the wires 220, 222 are twisted immediately behind the contact modules 104 and portions of the twisted wires 220, 222 are located within the housing 102. For example, the housing 102 includes rear pockets 450 at the loading end 108 behind the housing cavities 114. The rear pockets 450 are defined by shroud walls 452 of the housing 102. The twisted wires 220, 222 enter the pockets 450 and are thus located forward of the loading end 108 of the housing 102. Having the twisted portion so close to the terminals 230, 232 maintains the signal integrity and provides better wire management behind the housing 102.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112(f), unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A connector assembly comprising, a housing having housing cavities extending between a mating end and a loading end, the housing having module latches associated with corresponding housing cavities; and contact modules received in corresponding housing cavities, each contact module having first and second module cavities extending between a front end and a rear end of the contact modules, the contact modules being held within the housing cavity by the corresponding module latch, each contact module having an unshielded twisted pair (UTP) circuit, the UTP circuit includes first and second signal wires and first and second terminals terminated to the first and second signal wires, the signal wires being twisted along a length of the first and second signal wires;

wherein the contact module has a primary latch surface for securing the first and second terminals in the first and second module cavities, and the contact module has a secondary latch for securing the first and second terminals in the first and second module cavities;

wherein the first and second terminals comprise a latch configured to engage the primary latch surface of the contact module, and a secondary recess configured to receive the secondary latch of the contact module.

2. The connector assembly of claim 1, wherein the UTP circuits are pre-loaded into the first and second module cavities of the contact module prior to the contact module being loaded into the housing cavity.

3. The connector assembly of claim 1, wherein the contact modules are independently loaded into corresponding housing cavities through the loading end.

4. The connector assembly of claim 1, wherein the first and second terminals are entirely contained and secured within the contact modules such that no portion of the housing interacts directly with the first and second terminals.

5. The connector assembly of claim 1, wherein the housing includes rear pockets behind the housing cavities, the signal wires exiting the contact modules through the rear pockets, the signal wires being twisted in the rear pockets.

6. The connector assembly of claim 1, wherein each contact module holds only two terminals.

7. The connector assembly of claim 1, wherein the contact modules are arranged in rows and columns.

8. The connector assembly of claim 1, wherein a portion of a length of a twisted section of the twisted wires is positioned forward of the loading end of the housing.

9. The connector assembly of claim 1, wherein inter pair spacing between terminals of adjacent contact modules is greater than intra pair spacing between the first and second terminals within the corresponding contact module.

10. The connector assembly of claim 1, wherein the contact module has a plurality of walls with an open mating end for receiving a mating terminal, wherein one of the walls includes a primary latch surface for interfacing with at least one of the first and second terminals, and wherein one of the walls includes a secondary latch for interfacing with at least one of the first and second terminals, and wherein one of the walls includes a projection for interfacing with the corresponding module latch.

11. The connector assembly of claim 1, wherein the contact module comprises a hinge recess cavity exposed to the first and second module contacts, the hinge recess cavity receives a hinged latch configured to block the removal of the first and second terminals from the first and second module cavities.

12. The connector assembly of claim 1, wherein each housing cavity is sized to receive the corresponding contact module, the module latches being deflectable and configured to mate with a projection of the corresponding contact module to secure the contact module in the housing cavity.

13. The connector assembly of claim 1, further comprising a terminal position assurance device movably coupled to the mating end of the housing and configured to interface with the module latches.

14. The connector assembly of claim 1, further comprising a terminal position assurance device movable between a released position and a blocking position, the terminal position assurance device being movable to the blocking position only when the module latches are latched to the contact modules.

15. The connector assembly of claim 1, further comprising a terminal position assurance device movable between a released position and a blocking position, the terminal position assurance device blocking the module latches when in the blocking position to restrict the module latches from disengaging from the contact modules.

16. The connector assembly of claim 1, wherein the housing includes separating wall between the housing cavities such that the separating walls separate each contact module from each other contact module.

17. The connector assembly of claim 16, wherein the separating wall provides shielding between the contact modules.

18. A connector assembly comprising, a housing having housing cavities extending between a mating end and a loading end, the housing having module latches associated with corresponding housing cavities; and contact modules received in corresponding housing cavities, each contact module having first and second module cavities extending between a front end and a rear end of the contact modules, the contact modules being held within the housing cavity by the corresponding module latch, each contact module having an unshielded twisted pair (UTP) circuit, the UTP circuit includes first and second signal wires and first and second terminals terminated to the first and second signal wires, the signal wires being twisted along a length of the first and second signal wires, the contact modules comprising a primary latch surface, and a secondary latch for receiving the UTP circuit;

wherein the first and second terminals comprise a latch configured to engage the primary latch surface of the contact module, and a secondary recess configured to receive the secondary latch of the contact module.

19. The connector assembly of claim 18, wherein the UTC circuits are pre-loaded into the first and second module cavities of the contact module prior to the contact module being loaded into the housing cavity.

* * * * *